US008580190B2

(12) United States Patent
Hattendorf

(10) Patent No.: US 8,580,190 B2
(45) Date of Patent: Nov. 12, 2013

(54) DURABLE IRON-CHROMIUM-ALUMINUM ALLOY SHOWING MINOR CHANGES IN HEAT RESISTANCE

(75) Inventor: Heike Hattendorf, Werdohl (DE)

(73) Assignee: Outokumpu VDM GmbH, Werdohl (DE)

( * ) Notice: Subject to any disclaimer, the term of this patent is extended or adjusted under 35 U.S.C. 154(b) by 416 days.

(21) Appl. No.: 12/937,460

(22) PCT Filed: Apr. 2, 2009

(86) PCT No.: PCT/DE2009/000450

§ 371 (c)(1), (2), (4) Date: Oct. 12, 2010

(87) PCT Pub. No.: WO2009/124530

PCT Pub. Date: Oct. 15, 2009

(65) Prior Publication Data

US 2011/0031235 A1 Feb. 10, 2011

(30) Foreign Application Priority Data

Apr. 10, 2008 (DE) ..... 10 2008 018 135

(51) Int. Cl.

| | |
|---|---|
| ***C22C 38/22*** | (2006.01) |
| ***C22C 38/06*** | (2006.01) |
| ***H05B 3/10*** | (2006.01) |

(52) U.S. Cl.

USPC ..... 420/40; 420/63; 420/79; 420/81; 148/325; 219/553

(58) Field of Classification Search

USPC ..... 420/40, 63, 79, 81; 148/325; 219/553

See application file for complete search history.

(56) References Cited

U.S. PATENT DOCUMENTS

| | | | | |
|---|---|---|---|---|
| 4,277,374 | A | 7/1981 | Lula et al. | |
| 4,414,023 | A | 11/1983 | Aggen et al. | |
| 4,859,649 | A | 8/1989 | Boehnke et al. | |
| 5,298,093 | A | 3/1994 | Okamoto | |
| 5,411,610 | A | 5/1995 | Araki et al. | |
| 6,485,679 | B1 | 11/2002 | Sundstroem et al. | |
| 6,773,660 | B2 * | 8/2004 | Cedergren et al. | 420/43 |
| 7,347,903 | B2 | 3/2008 | Yamadera et al. | |
| 2007/0041862 | A1 | 2/2007 | Hattendorf et al. | |
| 2008/0210348 | A1 * | 9/2008 | Goransson et al. | 148/537 |

FOREIGN PATENT DOCUMENTS

| | | |
|---|---|---|
| CN | 1537177 | 10/2004 |
| DE | 199 28 842 | 1/2001 |
| DE | 10 2005 016 722 | 2/2006 |
| DE | 600 23 699 | 7/2006 |

(Continued)

OTHER PUBLICATIONS

Machine-English translation of DE 19928842 (A1), Koewer Jutta, et al. , Jan. 4, 2001.*

(Continued)

*Primary Examiner* — Deborah Yee

(74) *Attorney, Agent, or Firm* — Jordan and Hamburg LLP

(57) ABSTRACT

An iron-chromium-aluminum alloy having a long service life and exhibiting little change in heat resistance, comprising (as percentages by weight) 4.5 to 6.5% Al, 16 to 24% Cr, 1.0 to 4.0% W, 0.05 to 0.7% Si, 0.001 to 0.5% Mn, 0.02 to 0.1% Y, 0.02 to 0.1% Zr, 0.02 to 0.1% Hf, 0.003 to 0.030% C, 0.002 to 0.03% N, a maximum of 0.01% S, and a maximum of 0.5% Cu, the remainder being iron and the usual steel production-related impurities.

40 Claims, 3 Drawing Sheets

(56) References Cited

FOREIGN PATENT DOCUMENTS

| | | |
|---|---|---|
| EP | 0 290 719 | 11/1988 |
| EP | 0 387 670 | 9/1990 |
| EP | 0 402 640 | 12/1990 |
| EP | 0 516 267 | 12/1992 |
| EP | 0 545 753 | 6/1993 |
| EP | 1 340 829 | 9/2003 |
| JP | 4-128343 | 4/1992 |
| JP | 4-128345 | 4/1992 |
| JP | 5-132741 | 5/1993 |
| JP | 5-171362 | 7/1993 |
| JP | 6-212363 | 8/1994 |
| JP | 8-269730 | 10/1996 |
| JP | 9-053156 | 2/1997 |
| WO | WO-01/49441 | 7/2001 |
| WO | WO-02/20197 | 3/2002 |

OTHER PUBLICATIONS

Ralf Buergel, "Handbook of High-Temperature Materials Technology", Vieweg Publishing House, Braunschweig 1998, pp. 274-280.

Harald Pfeiffer, et al.; "Scale-Proof Alloys", Springer Publishing House, Gerlin/Goettingen/Heidelberg/ 1963, pp. 111, 112 and 113.

J. Kloewer; "Factors affecting the oxidation behaviour of thin Fe-Cr-Al foils, Part II: The effect of alloying elments: Overdropping", Materials and Corrosion 51, 2000, pp. 373-385.

H. Echsler, et al.; "Oxidation behaviour of Fe-Cr-Al alloys during resistance and furnace heating", Materials and Corrosion 2006, 57, No. 2, pp. 115-121.

I. Gurrappa, et al.; "Factors governing breakaway oxidation of FeCrAl-based alloys", Materials and Corrosion 51, 2000, pp. 224-235.

* cited by examiner

DURABLE IRON-CHROMIUM-ALUMINUM ALLOY SHOWING MINOR CHANGES IN HEAT RESISTANCE

BACKGROUND OF THE INVENTION

The invention relates to an iron-chromium-aluminum alloy having a long service life and exhibiting little change in heat resistance, which is produced by way of fusion metallurgy.

Iron-chromium-aluminum-tungsten alloys are used to produce electric heating elements and catalyst carriers. These materials form a dense, firmly adhering aluminum oxide layer, which protects them from damage at high temperatures (for example up to 1400° C.). This protection is improved by the addition of in the range of 0.01 to 0.3% of so-called reactive elements, such as Ca, Ce, La, Y, Zr, Hf, Ti, Nb and W, which, among other things, improve the adhesive strength of the oxide layer and/or the layer growth, as is described, for example in "Ralf Bürgel, *Handbuch der Hochtemperatur-Werkstofftechnik* (Handbook of High-Temperature Materials Technology), Vieweg Publishing House, Braunschweig 1998", starting on page 274.

The aluminum oxide layer protects the metallic material from rapid oxidation. In the process, the layer itself grows, albeit very slowly. This growth takes place while consuming the aluminum content of the material. When aluminum is no longer present, other oxides (chromium and iron oxides) grow, and the metal content of the material is consumed very quickly, so that the material fails due to destructive corrosion. The time until failure is referred to as the service life. Increasing the aluminum content extends the service life.

In all of concentration information in the specification, as well as in the patent claims, % denotes information in percentage by weight.

From WO 02/20197 A1 a ferritic stainless steel alloy is known, particularly for use as a heating element. The alloy is formed by a powder metallurgically produced Fe—Cr—Al alloy, comprising less than 0.02% C, ≤0.5% Si, ≤0.2% Mn, 10.0 to 40.0% Cr, ≤0.6% Ni, ≤0.01% Cu, 2.0 to 10.0% Al, one or more element(s) of the group of reactive elements such as Sc, Y, La, Ce, Ti, Zr, Hf, V, Nb, Ta, at levels ranging between 0.1 and 1.0%, and a remainder of iron and unavoidable impurities.

DE 199 28 842 A1 describes alloy comprising 16 to 22% Cr, 6 to 10% Al, 0.02 to 1.0% Si, a maximum of 0.5% Mn, 0.02 to 0.1% Hf, 0.02 to 0.1% Y, 0.001 to 0.01% Mg, a maximum of 0.02% Ti, a maximum of 0.03% Zr, a maximum of 0.02% SE, a maximum of 0.1% Sr, a maximum of 0.1% Ca, a maximum of 0.5% Cu, a maximum of 0.1% V, a maximum of 0.1% Ta, a maximum of 0.1% Nb, a maximum of 0.03% C, a maximum of 0.01% N, a maximum of 0.01% B, and a remainder of iron and steel production-related impurities, for the use as a carrier foil for exhaust gas catalysts, as a heating element, and as a component in industrial furnace construction and in gas burners.

EP 0 387 670 B1 describes an alloy comprising (in % by weight) 20 to 25% Cr, 5 to 8% Al, 0.03 to 0.08% yttrium, 0.004 to 0.008% nitrogen, 0.020 to 0.040% carbon, and approximately equal amounts of 0.035 to 0.07% Ti and 0.035 to 0.07% zirconium, and a maximum of 0.01% phosphorus, a maximum of 0.01% magnesium, a maximum of 0.5% manganese, a maximum of 0.005% sulfur, the remainder being iron, wherein the sum of the contents of Ti and Zr is 1.75 to 3.5% times as great as the sum, as a percentage, of the contents of C and N, and steel production-related impurities. Ti and Zr can be partially or completely replaced with hafnium and/or tantalum or vanadium.

EP 0 290 719 B1 describes an alloy comprising (in % by weight) 12 to 30% Cr, 3.5 to 8% Al, 0.008 to 0.10% carbon, a maximum of 0.8% silicon, 0.10 to 0.4% manganese, a maximum of 0.035% phosphorus, a maximum of 0.020% sulfur, 0.1 to 1.0% molybdenum, a maximum of 1% nickel and the additions of 0.010 to 1.0% zirconium, 0.003 to 0.3% titanium and 0.003 to 0.3% nitrogen, 0.005 to 0.05% calcium plus magnesium, as well as 0.003 to 0.80% rare earth metals, 0.5% niobium, the remainder being iron including incidental impurities, which is used, for example, as a wire for heating elements for electrically heated ovens, as a construction material for parts subject to thermal stress, and as a foil for producing catalyst carriers.

U.S. Pat. No. 4,277,374 describes an alloy comprising (in % by weight) up to 26% chromium, 1 to 8% aluminum, 0.02 to 2% hafnium, up to 0.3% yttrium, up to 0.1% carbon, up to 2% silicon, the remainder being iron, and preferred ranges being 12 to 22% for chromium and 3 to 6% for aluminum, which is used as a foil for producing catalyst carriers.

From U.S. Pat. No. 4,414,023 a steel is known, comprising (in % by weight) 8.0 to 25.0% Cr, 3.0 to 8.0% Al, 0.002 to 0.06% rare earth metals, and a maximum of 4.0% Si, 0.06 to 1.0% Mn, 0.035 to 0.07% Ti, 0.035 to 0.07% Zr, and including unavoidable impurities.

DE 10 2005 016 722 A1 discloses an iron-chromium-aluminum alloy having a long service life, comprising (in % by weight) 4 to 8% Al and 16 to 24% Cr, and additions of 0.05 to 1% Si, 0.001 to 0.5% Mn, 0.02 to 0.2% Y, 0.1 to 0.3% Zr and/or 0.02 to 0.2% Hf, 0.003 to 0.05% C, 0.0002 to 0.05% Mg, 0.0002 to 0.05% Ca, a maximum of 0.04% N, a maximum of 0.04% P, a maximum of 0.01% S, a maximum of 0.5% Cu, and the customary steel production-related impurities, the remainder being iron.

A detailed model of the service life of iron-chromium-aluminum alloys is described in the article by I. Gurrappa, S. Weinbruch, D. Naumenko, W. J. Quadakkers, *Materials and Corrosion* 51 (2000), on pages 224 to 235. The article highlights a model in which the service life of iron-chromium-aluminum alloys is said to be dependent on the aluminum content and the sample shape, wherein potential spalls are not taken into consideration in the formula (aluminum depletion model).

$$t_B = \left[4,4\times10^{-3}\times(C_0 - C_B)\times\frac{\rho\bullet f}{k}\right]^{\frac{1}{n}}$$

$$\text{where } f = 2\times\frac{\text{volume}}{\text{surface}}$$

$t_B$=Service life, defined as the time until other oxides occur as aluminum oxide $C_O$=Aluminum concentration at the beginning of oxidation $C_B$=Aluminum concentration when other oxides occur as aluminum oxides ρ=Specific density of the metallic alloy k=Oxidation rate constant n=Oxidation rate exponent Taking the spalls into consideration, the following formula is obtained for a flat sample having infinite width and length and a thickness d (f≈d):

$$t_B = 4,4\times10^{-3}\times(C_0 - C_B)\times\rho\times d\times k^{-\frac{1}{n}}\times(\Delta m^*)^{\frac{1}{n}-1}$$

where Δm* is the critical weight change at which the spalling begins.

Both formulas show that the service life is shortened as the aluminum content decreases and when the surface-to-volume ratio is high (or the sample thickness is smaller).

This becomes significant when thin foils in the dimensional range of approximately 20 μm to approximately 300 μm must be used for specific applications.

Heat conductors that are made of thin foils (for example a thickness of approximately 20 to 300 μm with a width in the range of one to several millimeters) are characterized by a large surface-to-volume ratio. This is advantageous when fast heating and cooling times are to be achieved, for example those required for heating elements used in glass ceramic fields, so as to make heating visibly faster and to achieve quick heating similar to that with a gas stove. At the same time, however, the large surface-to-volume ratio is disadvantageous for the service life of the heating element.

When using an alloy as a heat conductor, the behavior of the heat resistance must also be taken into consideration. In general, a constant voltage is applied to the heat conductor. If the resistance remains constant over the course of the service life of the heating element, the current and power of this heating element are also unchanged.

However, given the processes described above, in which aluminum is continuously consumed, this is not the case. As a result of the consumption of aluminum, the specific electric resistance of the material decreases. However, this is done by removing atoms from the metallic matrix, which is to say the cross-section is reduced, which results in increased resistance (see Harald Pfeifer, Hans Thomas, Zunderfeste Legierungen [Scale-Proof Alloys], Springer publishing house, Berlin/Göttingen/Heidelberg/ 1963 page 111). Due to the stresses that develop as the oxide layer grows and the stresses resulting from the different coefficients of expansion of the metal and oxide when heating and cooling the heat conductor, additional stresses are created, which can result in a deformation of the foil and a consequent dimensional change (see also H. Echsler, H. Hattendorf, L. Singheiser, W. J. Quadakkers, Oxidation behaviour of Fe—Cr—Al alloys during resistance and furnace heating, *Materials and Corrosion* 57 (2006) 115-121). Depending on the interaction of the dimensional changes with the change in the specific electric resistance, an increase or a decrease in the heat resistance of the heat conductor may occur over the course of the usage. These dimensional changes become more significant with the number of times that the heat conductor is heated and cooled, that is, the length of the cycle. In the process, the foil is deformed in the manner of watch glass. This creates additional damage to the foil, so that this is another important failure mechanism in the very short and fast cycles of foils, which may even be decisive, depending on the cycle and temperature.

An increase in the heat resistance over time is generally observed for wires made of iron-chromium-aluminum alloys (Harald Pfeifer, Hans Thomas, *Zunderfeste Legierungen* [Scale-Proof Alloys], Springer Publishing House, Berlin/Göttingen/Heidelberg/1963 page 112) (FIG. 1), while a drop in heat resistance is generally observed for heat conductors in the form of foils made of iron-chromium-aluminum alloys (FIG. 2).

If the heat resistance $R_W$ rises over time, the power P decreases, with the voltage being kept constant, at the heating element that is produced therefrom, which is calculated with $P=U*I=U^2/R_W$. As the power at the heating element decreases, so does the temperature of the heating element. The service life of the heat conductor and therefore of the heating element is thereby extended. However, heating elements often have a lower limit for the power, so that this effect cannot be employed arbitrarily to extend the service life. If, in contrast, the heat resistance $R_W$ decreases over time, the power P increases at the heating element, with the voltage being kept constant. However, as the power increases, so does the temperature and, as a result, the service life of the heat conductor or heating element is shortened. This is intended to keep the variances of the heat resistance as a function of time within a narrowly limited range around zero.

The service life and the behavior of the heat resistance can be measured, for example, using an accelerated service life test. Such a test is described, for example, in Harald Pfeifer, Hans Thomas, *Zunderfeste Legierungen* [Scale-Proof Alloys], Springer Publishing House, Berlin/Göttingen/Heidelberg/1963, on page 113. The test is conducted using a switching cycle of 120 s, at a constant temperature, on wire that is shaped into helices having a diameter of 0.4 mm. Temperatures of 1200° C. and 1050° C. are proposed as the test temperatures. However, since specifically the behavior of thin foils is to be analyzed in this case, the test was modified as follows:

Foil strips measuring 50 μm in thickness and 6 mm in width were clamped between 2 current feed-throughs and heated to 1050° C. by applying a voltage. In each case, heating to 1050° C. was performed for 15 s, then the power supply was interrupted for 5 s. At the end of the service life, the foil failed in that the remaining cross-section thoroughly melted. The temperature is measured automatically during the service life test using a pyrometer and, where necessary, is corrected to the target temperature by a program controller.

The burning period is used as a measure of the service life. The burning period or burning time is the sum of the times during which the sample is heated. The burning period is the time until failure of the samples, while the burning time is the running time during an experiment. In all subsequent figures and tables, the burning period or the burning time is given as a relative value in %, relative to the burning period of a reference sample, and is referred to as the relative burning period or relative burning time.

From the prior art described above, it is known that minor additions of Y, Zr Ti, Hf, Ce, La, Nb, V, and the like heavily influence the service life of FeCrAl alloys.

The market places increased demands on products which require a longer service life and an increased usage temperature of the alloys.

SUMMARY OF THE INVENTION

It is the object of the invention to provide an iron-chromium-aluminum alloy for a specific range of applications, which has a longer service life than the iron-chromium-aluminum alloys used previously, while at the same time exhibiting little change in heat resistance over time for a specified application temperature. In addition, the alloy is to be provided for specific applications, which are subject to short, fast cycles, while also requiring a particularly long service life.

This object is achieved by an iron-chromium-aluminum alloy having a long service life and exhibiting little change in heat resistance, comprising:

| | |
|---|---|
| 4.5 to 6.5% | Al |
| 16 to 24% | Cr |
| 1.0 to 4.0% | W |
| 0.05 to 0.7% | Si |
| 0.001 to 0.5% | Mn |
| 0.02 to 0.1% | Y |
| 0.02 to 0.1% | Zr |
| 0.02 to 0.1% | Hf |
| 0.003 to 0.030% | C |
| 0.002 to 0.030% | N |
| a maximum of 0.01% | S |
| a maximum of 0.5% | Cu |

and a remainder of iron and the usual steel production-related impurities.

DETAILED DESCRIPTION OF THE INVENTION

Figure 1:
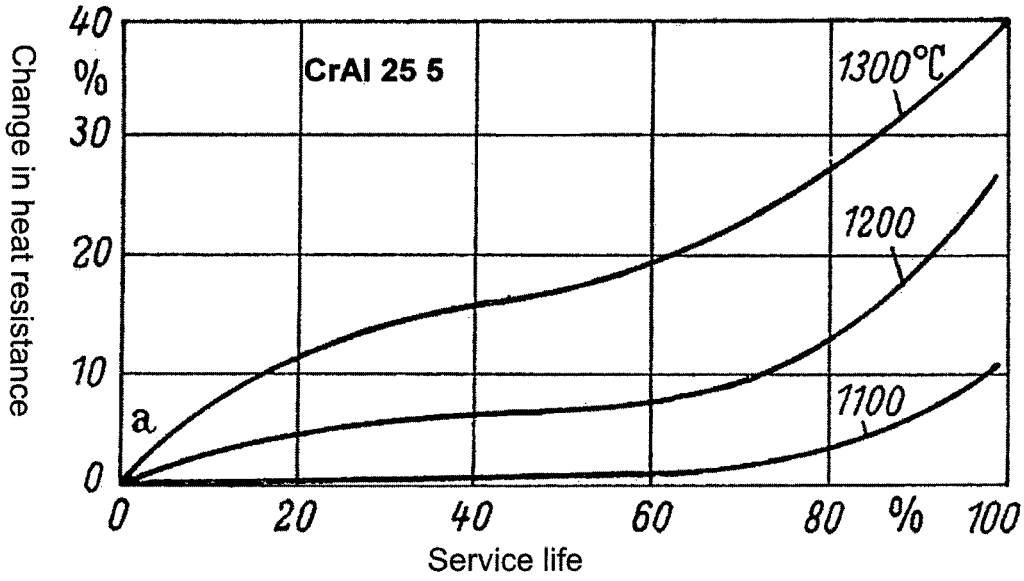
FIG. 1 is heat resistance curves for wire of a prior art alloy according to the heat conductor test for wire.

The alloy may advantageously be smelted with 0.0001 to 0.05% Mg, 0.0001 to 0.03% Ca, and 0.010 to 0.030% P in order to be able to adjust optimal material properties in the foil.

In addition, it is advantageous for the alloy to satisfythe following relationship (formula 1):

$$I=-0.015+0.065*Y+0.030*Hf+0.095*Zr+0.090*Ti-0.065*C<0,$$

where I reflects the inner oxidation of the material, and where Y, Hf, Zr, Ti, C denote the concentration of the alloying elements in percentages by weight.

The element Y may optionally be replaced, either entirely or partially, with at least one of the elements Sc and/or La and/or Ce, wherein ranges between 0.02 and 0.1% are conceivable for a partial substitution.

The element Hf may likewise be optionally replaced, either entirely or partially, with at least one of the elements Sc and/or Ti and/or Ce, wherein ranges between 0.01 and 0.1% are conceivable for a partial substitution.

Advantageously, the alloy may be smelted using a maximum of 0.005% S.

Advantageously, the alloy may contain a maximum of 0.010% O after smelting.

Preferred Fe—Cr—Al alloys are characterized by the following composition:

| | | |
|---|---|---|
| Al | 4.8-6.2% | 4.9-5.8% |
| Cr | 18-23% | 19-22% |
| W | 1.0-3% | 1.5-2.5% |
| Si | 0.05-0.5% | 0.05-0.5% |
| Mn | 0.005-0.5% | 0.005-0.5% |
| Y | 0.03-0.1% | 0.03-0.09% |
| Zr | 0.02-0.08% | 0.02-0.08% |
| Hf | 0.02-0.08% | 0.02-0.08% |
| C | 0.003-0.020% | 0.003-0.020% |
| Mg | 0.0001-0.05% | 0.0001-0.05% |
| Ca | 0.0001-0.03% | 0.0001-0.03% |
| P | 0.002 to 0.030% | 0.002 to 0.030% |
| S | a maximum of 0.01% | a maximum of 0.01% |
| N | a maximum of 0.03% | a maximum of 0.03% |
| O | a maximum of 0.01% | a maximum of 0.01% |
| Cu | a maximum of 0.5% | a maximum of 0.5% |
| Ni | a maximum of 0.5% | a maximum of 0.5% |
| Mo | a maximum of 0.1% | a maximum of 0.1% |
| Fe | remainder | remainder |

The alloy according to the invention can preferably be employed for use as a foil for heating elements, and particularly for electrically heatable heating elements.

It is particularly advantageous for the alloy according to the invention to be used for foils in the thickness range of 0.02 to 0.03 mm, and particularly 20 to 200 μm, or 20 to 100 μm.

The use of the alloy as a foil heat conductor for applications in cook tops, and notably in glass ceramic cook tops, is also advantageous.

Furthermore, a use of the alloy as a carrier foil in heatable metallic exhaust gas catalysts or the use of the alloy as a foil in fuel cells is also conceivable.

The details and advantages of the invention will be described in more detail in the following examples.

Table 1 shows proprietary iron-chromium-aluminum alloys T1 to T6 produced on a large scale, proprietary laboratory melts L1 to L7, A1 to A5, V1 to V17, and the alloy E1 according to the invention.

With respect to the alloys produced in a laboratory, a foil measuring 50 μm thick was produced from material that was cast in blocks using hot and cold forming and suitable process annealing steps. The foil was cut into strips of approximately 6 mm in width.

With respect to the alloys produced on a large scale, a sample having a strip thickness of 50 μm was taken from a large-scale production using ingots or continuous casting and hot and cold forming processes, with process annealing steps as necessary, and cut to a width of approximately 6 mm.

The heat conductor test for foils described above was carried out on these foil strips.

FIG. 1 shows, by way of example, a graphical representation of the heat resistance curve according to the heat conductor test for wire according to the prior art.

Figure 2:
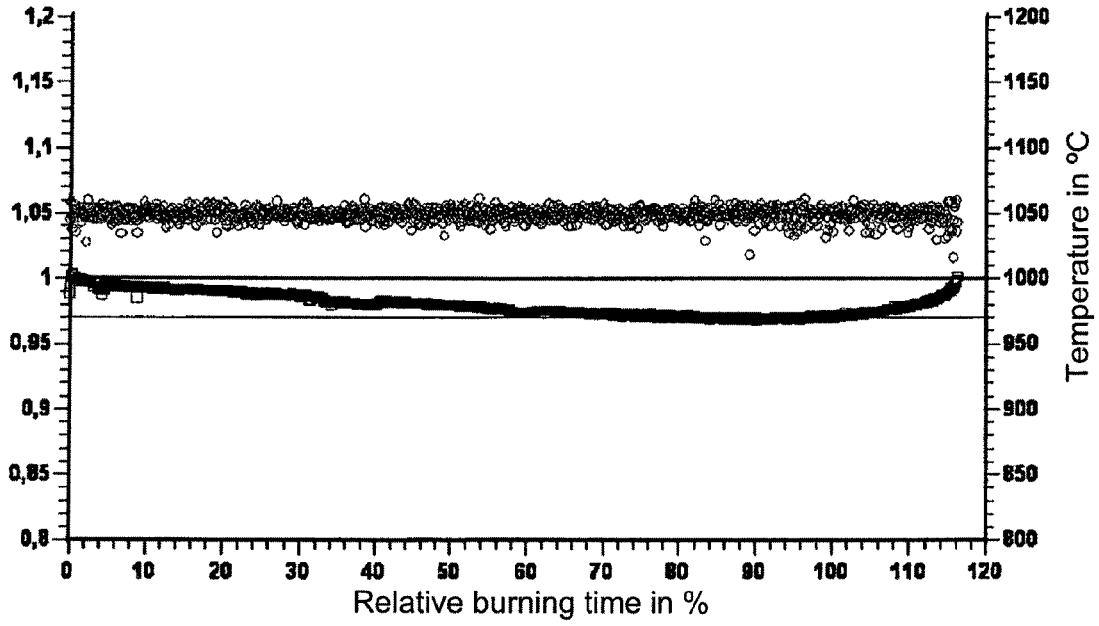
FIG. 2 is the heat resistance curve for a batch of alloy according to the heat conductor test for foils.

FIG. 2 shows, by way of example, the heat resistance curve for batch T6 according to the heat conductor test for foils, using an iron-chromium-aluminum alloy (Aluchrome Y) having the following composition:

| | |
|---|---|
| Cr | 20.7% |
| Al | 5.2% |
| Si | 0.15% |
| Mn | 0.22% |
| Y | 0.04% |
| Zr | 0.04% |
| Ti | 0.04% |
| C | 0.043% |
| N | 0.006% |
| S | 0.001% |
| Cu | 0.03%. |

Figure 3:
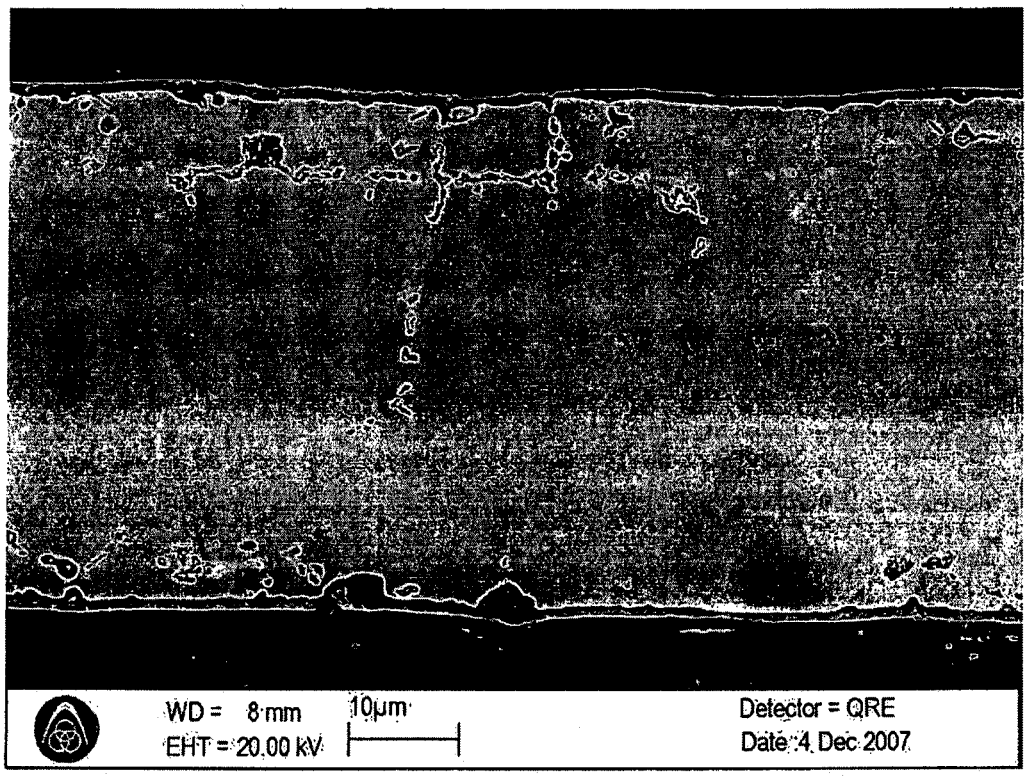
FIG. 3 is a microphotograph showing inner oxidation of a specified sample after a specified burning time.

FIG. 3 shows the inner oxidation (I) of A4 according to Table 1 after a relative burning period of 25%.

The resistance is shown at the beginning of the measurement, relative to the starting value thereof. It shows a decrease in the heat resistance. Toward the end of the further course of the process, just prior to the sample burning through, the heat resistance rises drastically (in FIG. 1 starting at approximately 100% relative burning time). Hereinafter, $A_W$ denotes the maximum variance of the heat resistance ratio from the starting value of 1.0 at the beginning of the experiment (or shortly after the contact resistance starts to develop) until the beginning of the steep rise.

This material (Aluchrome Y) typically has a relative burning period of approximately 100% and an $A_w$ of approximately −1 to −3%, as examples T4 to T6 in Table 2 show.

The results of the service life tests are shown in Table 2. The relative burning period stated in each case in Table 2 is arrived at by averaging at least 3 samples. Furthermore, the particular $A_W$ is entered for each batch. T4 to T6 are 3 batches of the iron-chromium-aluminum alloy Aluchrome Y having a composition of approximately 20% chromium, approximately 5.2% aluminum, approximately 0.03% carbon, and additions of Y, Zr, and Ti of approximately 0.05% each. They achieve a relative burning period of 91% (T4) to 124% (T6) and an outstanding $A_W$ value of −1 to −3%.

Furthermore, Table 2 shows batches T1 to T3 of the material Aluchrome YHf, comprising 19 to 22% Cr, 5.5 to 6.5% aluminum, a maximum of 0.5% Mn, a maximum of 0.5% Si, a maximum of 0.05% carbon, and additions of a maximum of 0.10% Y, a maximum of 0.07% Zr, and a maximum of 0.1% Hf. This material can be used, for example, not only as a foil for catalyst carriers, but also as a heat conductor. When subjecting batches T1 to T3 to the above-described heat conductor test for foils, the considerably extended service lives (burning period) of T1 with 188%, T2 with 152%, and T3 with 189% are apparent. T1 has a longer service life than T2, which is due to the aluminum content being increased from 5.6 to 5.9%. T1 has an $A_W$ of −5% and T2 one of −8%. In particular an $A_W$ of −8% is too high and experience has shown that it leads to a considerable temperature increase of the component, which compensates for the longer service life of this material, and thereby does not provide an advantage on an overall basis. Tables 1 and 2 show batch T3 which, as with T1 and T2, comprises an iron-chromium-aluminum alloy having 20.1% Cr, 6.0% aluminum, 0.12% Mn, 0.33% Si, 0.008% carbon, and additions of 0.05% Y, 0.04% Zr, and 0.03% Hf. However, contrary to L1 and L2, it has a very low carbon content of only 0.008%.

The goal was now to extend the service life beyond the level of 189% reached with T3, while achieving an $A_W$ of approximately 1% to −3%.

For this purpose, the laboratory batches L1 to L7, A1 to A5, V1 to V17, and the subject matter of the invention E1, as described above, were produced and examined.

A longer service life than T3 was achieved by the laboratory batches A1 with 262%, A3 with 212%, A4 with 268%, and A5 with 237%, V9 with 224%, V10 with 271%, and the subject matter of the invention E1 with 323%, the highest value that was achieved.

The alloys A1, A3, A4, A5, and V9, which are also good, have already been described in DE 10 2005 016 722 A1. However, they exhibit an $A_W$>2 which, over the course of time, when used in a heating element, results in an impermissibly high drop in power.

In addition, an alloy that tends toward increased inner oxidation (I) is undesirable (FIG. 3). Over the course of the service life, this leads to increased brittleness of the heat conductor, which is not desirable in a heating element.

This can be prevented if the alloy satisfies the following relationship (formula 1):

$$I=-0.015+0.065*Y+0.030*Hf+0.095*Zr+0.090*Ti-0.065*C<0,$$

where I is the value for the inner oxidation.

Reference is made to Table 2:

Alloys T1 to T6, V8, V11 to V13, and the subject matter of the invention E1 all have an I value of less than zero and exhibit no inner oxidation. Alloys A1 to A5, V9, and V10 have an I value of greater than zero and exhibit increased inner oxidation.

E1 represents an alloy which, according to the invention, can be used for foils in application ranges of 20 μm to 0.300 mm thickness.

In addition to the required considerably longer service life of 323%, the alloy E1 according to the invention exhibits a very advantageous behavior of heat resistance with a mean $A_W$ of −1.3%, and meets the condition of I<0.

Surprisingly, it exhibits such a long service life due to the addition of W<4%, and preferably <3%. While tungsten results in increased oxidation, the quantity added here does not negatively affect the service life. As a result, the maximum content of tungsten is limited to 4%.

Tungsten strengthens the alloy. This contributes to dimensional stability during cyclical deformation and to the $A_W$ ranging between −3 and 1%. Therefore, a lower limit of 1% should always be satisfied.

The same information as recited for tungsten also applies to Mo and Co.

A minimum content of 0.02% Y is necessary to achieve the oxidation resistance-increasing effect of Y. For economical reasons, the upper limit is set to 0.1%.

A minimum content of 0.02% Zr is required to obtain a good service life and a low $A_W$. For cost reasons, the upper limit is set to 0.1% Zr.

A minimum content of 0.02% Hf is necessary to achieve the oxidation resistance-increasing effect of Hf. For economic reasons, the upper limit is set to 0.1% Hf.

To achieve a low $A_W$ value, the carbon content should be less than 0.030%. To achieve good processability, it should be higher than 0.003% .

The nitrogen content should be a maximum of 0.03%, so as to prevent the formation of nitrides, which negatively impact processability. To ensure good processability of the alloy, it should be higher than 0.003%.

The content of phosphorus should be less than 0.030%, because this surface-active element impairs oxidation resistance. The P content is preferably ≥0.002%.

The content of sulfur should be kept to a minimum, because this surface-active element impairs oxidation resistance. For this reason, a maximum of 0.01% S is established.

The oxygen content should be kept to a minimum, because otherwise the elements having an affinity for oxygen such as Y, Zr, Hf, Ti, and the like are bound primarily in oxidic form. The positive effect of the elements having an affinity for oxygen on the oxidation resistance is impaired, among other things, by the elements that have an affinity for oxygen and are bound in oxidic form being distributed very unevenly in the material and not being present to the necessary extent in the material. For this reason, a maximum of 0.01% O is established.

Chromium contents between 16 and 24% by weight have no crucial influence on the service life, as can be gleaned from J. Klöwer, *Materials and Corrosion* 51 (2000), pages 373 to 385. However, a certain content of chromium is required because chromium promotes the formation of the particularly stable and protective $\alpha$-$Al_2O_3$ layer. For this reason, the lower limit is set to 16%. Chromium contents of >24% make it difficult to process the alloy.

An aluminum content of at least 4.5% is necessary so as to obtain an alloy having a sufficient service life. Al contents of >6.5% do not further increase the service lives of foil heat conductors.

According to J. Klöwer, *Materials and Corrosion* 51 (2000), pages 373 to 385, the addition of silicon increases the service life by improving the adhesion of the cover layer. For this reason, a content of at least 0.05% by weight silicon is required. Excessively high Si contents make it difficult to process the alloy. For this reason, the upper limit is set to 0.7%

A minimum content of 0.001% Mn is required to improve processability. Manganese is limited to 0.5% because this element reduces the oxidation resistance.

Copper is limited to a maximum of 0.5% because this element reduces the oxidation resistance. The same applies to nickel.

The contents of magnesium and calcium are adjusted within a range of 0.0001 to 0.05% by weight and 0.0001 to 0.03% by weight, respectively.

B is limited to a maximum of 0.003% because this element reduces the oxidation resistance.

TABLE 1

Composition of the analyzed alloys

| | Charge | Cr | Mn | Si | Al | Y | Zr | Hf | Ti | Nb | W | Mg |
|---|---|---|---|---|---|---|---|---|---|---|---|---|
| T1 | 152891 | 20.0 | 0.18 | 0.25 | 5.9 | 0.05 | 0.05 | 0.04 | <0.01 | <0.01 | — | 0.009 |
| T2 | 55735 | 20.3 | 0.20 | 0.28 | 5.6 | 0.06 | 0.05 | 0.03 | 0.01 | <0.01 | — | 0.007 |
| T3 | 153190 | 20.1 | 0.12 | 0.33 | 6.0 | 0.05 | 0.04 | 0.03 | <0.01 | 0.01 | 0.04 | 0.008 |
| T4 | 58860 | 20.9 | 0.21 | 0.13 | 5.1 | 0.04 | 0.06 | <0.01 | 0.05 | <0.01 | <0.01 | 0.009 |
| T5 | 59651 | 20.8 | 0.26 | 0.17 | 5.1 | 0.05 | 0.05 | <0.01 | 0.05 | <0.01 | 0.02 | 0.010 |
| T6 | 153275 | 20.7 | 0.22 | 0.15 | 5.2 | 0.04 | 0.04 | <0.01 | 0.04 | <0.01 | 0.02 | 0.010 |
| L1 | 649 | 20.3 | 0.28 | 0.35 | 5.7 | 0.03 | 0.05 | <0.01 | <0.01 | — | — | 0.0004 |
| L2 | 717 | 20.8 | 0.24 | 0.34 | 4.9 | 0.04 | 0.06 | <0.01 | 0.05 | — | — | 0.0003 |
| L3 | 711 | 19.8 | 0.26 | 0.34 | 5.7 | 0.06 | <0.01 | 0.01 | <0.01 | — | — | 0.0008 |
| L4 | 712 | 19.3 | 0.25 | 0.33 | 5.5 | 0.03 | 0.05 | <0.01 | <0.01 | — | — | 0.0005 |
| L5 | 718 | 20.2 | 0.24 | 0.35 | 5.3 | 0.05 | 0.02 | <0.01 | <0.01 | — | — | 0.0006 |
| L6 | 713 | 19.8 | 0.25 | 0.36 | 5.3 | 0.05 | <0.01 | 0.04 | <0.01 | — | — | 0.0013 |
| L7 | 714 | 20.2 | 0.25 | 0.35 | 5.4 | 0.04 | <0.01 | <0.01 | <0.01 | — | — | 0.0003 |
| A1 | 767 | 19.6 | 0.25 | 0.35 | 5.7 | 0.05 | 0.21 | 0.03 | <0.01 | — | — | 0.0009 |
| A2 | 768 | 21.1 | 0.25 | 0.61 | 5.3 | 0.02 | 0.20 | <0.01 | 0.10 | — | — | 0.0005 |
| A3 | 1001 | 20.4 | 0.25 | 0.19 | 5.3 | 0.05 | 0.21 | <0.01 | <0.01 | 0.01 | <0.01 | 0.0005 |
| A4 | 1003 | 20.3 | 0.24 | 0.2 | 5.4 | 0.07 | 0.22 | 0.06 | <0.01 | 0.02 | <0.01 | 0.0005 |
| A5 | 1004 | 20.8 | 0.24 | 0.19 | 5.2 | 0.05 | 0.17 | 0.05 | <0.01 | 0.01 | <0.01 | 0.0005 |
| V1 | 715 | 20.4 | 0.25 | 0.59 | 5.6 | 0.04 | <0.01 | <0.01 | <0.01 | <0.01 | — | 0.0003 |
| V2 | 719 | 19.5 | 0.26 | 0.35 | 5.7 | 0.06 | <0.01 | <0.01 | <0.01 | <0.01 | — | 0.0007 |
| V3 | 754 | 20.5 | 0.24 | 0.03 | 5.2 | 0.01 | 0.05 | <0.01 | <0.01 | <0.01 | — | 0.0010 |
| V4 | 755 | 20.5 | 0.24 | 0.13 | 5.2 | 0.03 | 0.05 | <0.01 | <0.01 | <0.01 | — | 0.0010 |
| V5 | 760 | 20.6 | 0.24 | 0.13 | 5.2 | 0.08 | 0.05 | <0.01 | 0.06 | 0.01 | — | 0.0018 |
| V6 | 760 | 20.6 | 0.24 | 0.13 | 5.2 | 0.08 | 0.05 | <0.01 | 0.06 | 0.01 | — | 0.0013 |
| V7 | 1048 | 20.7 | 0.21 | 0.20 | 5.3 | 0.04 | 0.06 | 0.03 | <0.01 | <0.01 | — | 0.0006 |
| V8 | 1049 | 20.4 | 0.25 | 0.31 | 5.2 | 0.04 | 0.05 | 0.04 | <0.01 | <0.01 | <0.02 | 0.0002 |
| V9 | 1064 | 21.2 | 0.006 | 0.18 | 5.2 | 0.06 | 0.13 | 0.04 | <0.01 | 0.01 | <0.01 | 0.0005 |
| V10 | 1121 | 20.9 | 0.001 | 0.20 | 5.0 | 0.06 | 0.06 | 0.27 | <0.01 | 0.01 | <0.01 | 0.0010 |
| V11 | 1122 | 20.3 | 0.31 | 0.26 | 4.9 | 0.10 | 0.08 | 0.06 | <0.01 | 1.11 | 0.02 | 0.0006 |
| V12 | 1123 | 20.4 | 0.34 | 0.27 | 5.0 | 0.10 | 0.05 | 0.04 | <0.01 | 1.12 | 0.02 | 0.0006 |
| V13 | 1124 | 20.5 | 0.34 | 0.03 | 4.9 | 0.08 | 0.08 | 0.00 | <0.01 | 0.16 | 1.54 | 0.0004 |
| V14 | 1126 | 21.3 | 0.34 | 0.26 | 4.9 | 0.09 | 0.18 | 0.00 | <0.01 | 0.02 | 0.10 | 0.0005 |
| V15 | 1128 | 20.6 | 0.03 | 0.20 | 5.0 | 0.06 | 0.05 | 0.21 | <0.01 | 0.09 | <0.01 | 0.0008 |
| V16 | 1129 | 20.8 | 0.28 | 0.25 | 4.8 | 0.05 | 0.09 | 0.02 | 0.08 | 0.02 | <0.01 | 0.0004 |
| V17 | 1130 | 20.6 | 0.32 | 0.26 | 4.9 | 0.05 | 0.05 | 0.00 | 0.11 | 0.01 | 1.65 | 0.0004 |
| E1 | 1125 | 20.6 | 0.33 | 0.25 | 5.0 | 0.08 | 0.05 | 0.04 | <0.01 | 0.01 | 1.97 | 0.0009 |

| | Charge | Ca | S | C | N | P | Ni | Mo | Co | Cu | V | B | O |
|---|---|---|---|---|---|---|---|---|---|---|---|---|---|
| T1 | 152891 | 0.001 | 0.001 | 0.028 | 0.005 | 0.012 | 0.17 | <0.01 | 0.02 | 0.02 | 0.08 | 0.001 | |
| T2 | 55735 | 0.001 | 0.002 | 0.037 | 0.004 | 0.013 | 0.15 | 0.01 | 0.01 | 0.07 | 0.05 | <0.001 | |
| T3 | 153190 | 0.0004 | 0.002 | 0.008 | 0.007 | 0.011 | 0.18 | <0.01 | 0.02 | 0.02 | 0.04 | 0.001 | |
| T4 | 58860 | 0.003 | <0.001 | 0.041 | 0.006 | 0.012 | 0.15 | 0.01 | 0.02 | 0.01 | 0.06 | <0.001 | |
| T5 | 59651 | 0.0005 | <0.001 | 0.037 | 0.006 | 0.012 | 0.19 | 0.01 | 0.02 | 0.02 | 0.07 | <0.001 | |
| T6 | 153275 | 0.0016 | 0.001 | 0.043 | 0.006 | 0.012 | 0.17 | <0.01 | 0.02 | 0.03 | 0.05 | <0.001 | |
| L1 | 649 | 0.0002 | 0.003 | 0.007 | 0.005 | 0.003 | 0.02 | 0.01 | — | <0.01 | 0.01 | — | 0.001 |
| L2 | 717 | 0.0002 | 0.002 | 0.037 | 0.002 | 0.003 | — | <0.01 | — | <0.01 | 0.01 | <0.001 | 0.005 |
| L3 | 711 | 0.0003 | <0.001 | 0.002 | 0.002 | 0.003 | 0.02 | <0.01 | — | <0.01 | 0.01 | — | 0.001 |
| L4 | 712 | 0.0002 | 0.001 | 0.002 | 0.004 | 0.002 | <0.01 | <0.01 | — | <0.01 | 0.01 | — | 0.001 |
| L5 | 718 | 0.0003 | 0.005 | 0.003 | 0.003 | 0.003 | — | <0.01 | — | <0.01 | 0.01 | <0.001 | 0.003 |
| L6 | 713 | 0.0005 | 0.001 | 0.010 | 0.005 | 0.003 | 0.02 | 0.01 | — | <0.01 | 0.01 | — | 0.003 |
| L7 | 714 | 0.0002 | 0.001 | 0.031 | 0.005 | 0.002 | 0.02 | 0.01 | — | <0.01 | 0.01 | — | 0.001 |
| A1 | 767 | 0.0004 | 0.002 | 0.006 | 0.002 | 0.005 | — | 0.03 | — | <0.01 | 0.01 | — | 0.003 |
| A2 | 768 | 0.0002 | 0.002 | 0.020 | 0.007 | 0.006 | — | 0.03 | — | <0.01 | 0.01 | — | 0.002 |
| A3 | 1001 | 0.0002 | 0.003 | 0.022 | 0.003 | 0.002 | 0.02 | 0.01 | <0.01 | <0.01 | 0.02 | <0.001 | 0.009 |
| A4 | 1003 | 0.0002 | 0.002 | 0.018 | 0.004 | 0.002 | 0.04 | 0.02 | <0.01 | <0.01 | 0.02 | <0.001 | |
| A5 | 1004 | 0.0002 | 0.004 | 0.016 | 0.005 | 0.002 | 0.02 | 0.01 | <0.01 | <0.01 | 0.02 | <0.001 | 0.010 |
| V1 | 715 | 0.0003 | 0.001 | 0.003 | 0.006 | 0.002 | 0.02 | — | — | <0.01 | 0.01 | | 0.003 |
| V2 | 719 | 0.0003 | 0.004 | 0.004 | 0.002 | 0.003 | — | — | — | <0.01 | 0.01 | 0.005 | 0.001 |

TABLE 1-continued

| Composition of the analyzed alloys | | | | | | | | | | | | | |
|---|---|---|---|---|---|---|---|---|---|---|---|---|---|
| V3 | 754 | <0.0002 | 0.002 | 0.010 | 0.018 | 0.001 | <0.01 | <0.01 | <0.01 | <0.02 | 0.01 | <0.001 | |
| V4 | 755 | <0.0002 | 0.003 | 0.009 | 0.010 | 0.002 | <0.01 | <0.01 | <0.01 | <0.01 | 0.01 | <0.001 | 0.009 |
| V5 | 760 | <0.0002 | 0.003 | 0.017 | 0.006 | 0.002 | <0.01 | <0.01 | <0.01 | <0.01 | 0.01 | <0.001 | 0.009 |
| V6 | 760 | <0.0002 | 0.003 | 0.017 | 0.006 | 0.002 | <0.01 | <0.01 | <0.01 | <0.01 | 0.01 | <0.001 | 0.009 |
| V7 | 1048 | 0.0003 | 0.001 | 0.016 | 0.006 | 0.001 | 0.03 | <0.01 | <0.01 | <0.01 | 0.02 | <0.001 | 0.003 |
| V8 | 1049 | 0.0002 | 0.001 | 0.023 | 0.005 | <0.002 | 0.01 | <0.01 | <0.01 | <0.01 | 0.02 | <0.001 | 0.002 |
| V9 | 1064 | 0.0003 | 0.001 | 0.019 | 0.005 | <0.002 | <0.01 | 0.01 | <0.01 | <0.01 | 0.02 | <0.001 | 0.003 |
| V10 | 1121 | 0.0002 | 0.002 | 0.029 | 0.003 | <0.002 | 0.03 | <0.01 | <0.01 | <0.01 | 0.02 | <0.001 | 0.01 |
| V11 | 1122 | 0.0002 | 0.002 | 0.030 | 0.004 | 0.002 | 0.03 | 0.02 | <0.01 | <0.01 | 0.02 | <0.001 | 0.004 |
| V12 | 1123 | 0.0002 | 0.003 | 0.027 | 0.003 | 0.002 | 0.03 | 0.03 | <0.01 | <0.01 | 0.02 | <0.001 | <0.002 |
| V13 | 1124 | 0.0002 | 0.003 | 0.023 | 0.004 | 0.003 | 0.04 | 0.02 | <0.01 | <0.01 | 0.02 | <0.001 | 0.002 |
| V14 | 1126 | 0.0002 | 0.003 | 0.033 | 0.003 | 0.021 | 0.01 | 0.02 | <0.01 | <0.01 | 0.02 | <0.001 | 0.002 |
| V15 | 1128 | 0.0002 | 0.002 | 0.029 | 0.002 | 0.002 | <0.01 | <0.01 | <0.01 | <0.01 | 0.02 | <0.001 | 0.005 |
| V16 | 1129 | 0.0002 | 0.001 | 0.029 | 0.001 | 0.022 | 0.01 | 0.01 | <0.01 | <0.01 | 0.02 | <0.001 | 0.002 |
| V17 | 1130 | 0.0002 | 0.001 | 0.027 | 0.001 | 0.006 | 0.04 | 0.00 | <0.01 | <0.01 | 0.02 | <0.001 | <0.002 |
| E1 | 1125 | 0.0002 | 0.003 | 0.023 | 0.005 | 0.004 | 0.01 | <0.01 | <0.01 | <0.01 | 0.02 | <0.001 | 0.008 |

TABLE 2

Relative burning period and $A_W$ for the analyzed alloys and computation of Formulas B and I. Relative burning period in % Foil 50 μm × 6 mm, 1050° C., 15

| | | s "on"/5 s "off" | | $A_W$ in % | | I | Strong inner |
|---|---|---|---|---|---|---|---|
| | Batch | Mean Value | Standard Deviation | Mean Value | Standard Deviation | Less than 0 | oxidation |
| T1 | 152891 | 188 | 33 | −5.0 | <0.1 | −0.0074 | no |
| T2 | 55735 | 152 | 14 | −8.0 | <0.1 | −0.0080 | no |
| T3 | 153190 | 189 | 19 | −3.2 | 0.8 | −0.0078 | no |
| T4 | 58860 | 91 | 8 | −1.7 | 0.5 | −0.0053 | no |
| T5 | 59651 | 105 | 20 | −2.0 | <0.1 | −0.0052 | no |
| T6 | 153275 | 124 | 8 | −2.5 | 0.8 | −0.0077 | no |
| L1 | 649 | 102 | 14 | −2.3 | 0.6 | −0.0091 | |
| L2 | 717 | 128 | 41 | 2.3 | 0.5 | −0.0047 | |
| L3 | 711 | 96 | 16 | −2.3 | 0.5 | −0.0111 | |
| L4 | 712 | 120 | 24 | 2.7 | 0.6 | −0.0084 | |
| L5 | 718 | 149 | 18 | 1.0 | <0.1 | −0.0105 | |
| L6 | 713 | 116 | 22 | −2.3 | 0.6 | −0.0115 | |
| L7 | 714 | 112 | 19 | −1.0 | <0.1 | −0.0143 | |
| A1 | 767 | 262 | 15 | 3.0 | <0.1 | 0.0086 | yes |
| A2 | 768 | 175 | 14 | 3.3 | 0.6 | 0.0129 | yes |
| A3 | 1001 | 212 | 16 | 3.3 | 1.2 | 0.0068 | yes |
| A4 | 1003 | 268 | 22 | 3.9 | 0.7 | 0.0114 | yes |
| A5 | 1004 | 237 | 58 | 2.7 | 0.4 | 0.0049 | yes |
| V1 | 715 | 99 | 17 | −3.0 | <0.1 | −0.0127 | |
| V2 | 719 | 110 | 26 | −2.3 | 0.5 | −0.0117 | |
| V3 | 754 | 115 | 5 | 3.5 | 0.7 | −0.0104 | |
| V4 | 755 | 71 | 4 | −0.8 | 0.3 | −0.0087 | |
| V5 | 760 | 77 | 6 | 2.3 | 1.5 | −0.0008 | |
| V6 | 760 | 100 | 5 | 1.0 | 1.0 | −0.0008 | |
| V7 | 1048 | 156 | 23 | −1.9 | 0.9 | −0.0066 | |
| V8 | 1049 | 177 | 11 | −2.3 | 1.1 | −0.0076 | no |
| V9 | 1064 | 224 | 34 | 2.5 | 0.5 | 0.0012 | yes |
| V10 | 1121 | 271 | 30 | 0.3 | 0.4 | 0.0004 | yes |
| V11 | 1122 | 152 | 20 | 4.7 | 2.1 | −0.0017 | no |
| V12 | 1123 | 99 | 3 | 6.0 | <0.1 | −0.0042 | no |
| V13 | 1124 | 188 | 83 | 1.0 | <0.1 | −0.0035 | no |
| V14 | 1126 | 151 | 1 | −0.8 | 0.4 | 0.0057 | |
| V15 | 1128 | 180 | 47 | −1.3 | 0.4 | −0.0015 | |
| V16 | 1129 | 141 | 39 | 1.5 | <0.1 | 0.0026 | |
| V17 | 1130 | 105 | 49 | 1.0 | <0.1 | 0.0014 | |
| E1 | 1125 | 323 | 24 | −1.3 | 0.4 | −0.0054 | no |

The invention claimed is:

1. An iron-chromium-aluminum alloy having a long service life and exhibiting little change in heat resistance, comprising in % by weight:

4.9 to 5.8% Al;

16 to 24% Cr;

1.0 to 4.0% W;

0.05 to 0.7% Si;

0.001 to 0.5% Mn;

Y and/or at least one of Sc, La and Ce, the total amount of Y and/or at least one of Sc, La and Ce being 0.02 to 0.1%;

a Zr-containing portion consisting of Zr or Zr and at least one of Sc, La and Ce, the total amount of the Zr-containing portion being 0.02 to 0.1%;

a Hf-containing portion consisting of Hf or Hf and at least one of Sc, La and Ce, the total amount of the Hf-containing portion being 0.02 to 0.1%;

wherein Ti replaces a portion of at least one of Zr and Hf in the Zr-containing and Hf-containing portions in a total amount not exceeding 0.1%;

0.003 to 0.030% C;

0.002 to 0.03% N;

a maximum of 0.01% S;

a maximum of 0.5% Cu;

the remainder being iron and usual steel production-related impurities, wherein Y, Hf, Zr, Ti and C satisfy the formula:

$I=-0.015+0.065*Y+0.030*Hf+0.095*Zr+0.090*Ti-0.065*C<0$, where I is the inner oxidation, and the numbers preceding Y, Hf, Zr, Ti, C denote the concentration of those elements in % by weight.

2. The alloy according to claim 1, comprising 4.9 to 5.5% Al by weight.

3. The alloy according to claim 1, comprising 18 to 23% Cr by weight.

4. The alloy according to claim 1, comprising 19 to 22% Cr by weight.

5. The alloy according to claim 1, comprising 0.05 to 0.5% Si by weight.

6. The alloy according to claim 1, comprising 0.005 to 0.5% Mn by weight.

7. The alloy according to claim 1, comprising 0.03 to 0.09% Y by weight.

8. The alloy according to claim 1, comprising 0.02 to 0.08% Zr by weight.

9. The alloy according to claim 1, comprising 0.02 to 0.08% Hf by weight.

10. The alloy according to claim 1, comprising 0.003 to 0.020% C by weight.

11. The alloy according to claim 1, further comprising 0.0001 to 0.03% Mg by weight.

12. The alloy according to claim 1, further comprising 0.0001 to 0.02% Mg by weight.

13. The alloy according to claim 1, further comprising 0.0002 to 0.01% Mg by weight.

14. The alloy according to claim 1, further comprising 0.0001 to 0.02% Ca by weight.

15. The alloy according to claim 1, further comprising 0.0002 to 0.01% Ca by weight.

16. The alloy according to claim 1, further comprising 0.003 to 0.025% P by weight.

17. The alloy according to claim 1, further comprising 0.003 to 0.022% P by weight.

18. The alloy according to claim 1, which is free of Y and includes at least one of the elements Sc, La and Ce.

19. The alloy according to claim 1, comprising Y and at least one of the elements Sc and/or La and/or Ce.

20. The alloy according to claim 1, wherein at least one of Sc, La and Ce are present in the alloy and the sum of Hf, Zr and at least one of Sc, La and Ce being 0.02 to 0.1% by weight of the alloy, and the sum of at least one of Sc, La and Ce being at least 0.01% by weight of the alloy.

21. The alloy according to claim 1, comprising a maximum of 0.02% N by weight and a maximum of 0.005% S by weight.

22. The alloy according to claim 1, comprising a maximum of 0.01% N by weight and a maximum of 0.003% S by weight.

23. The alloy according to claim 1, further comprising a maximum of 0.002% by weight boron.

24. A heating element, comprising a foil of the alloy according to claim 1.

25. An electrically heatable heating element, comprising a foil of the alloy according to claim 1.

26. An electrically heatable heating element according to claim 25, wherein thickness of the foil is 0.020 to 0.30 mm.

27. An electrically heatable heating element according to claim 25, wherein thickness of the foil is 20 to 200 μm.

28. An electrically heatable heating element according to claim 25, wherein thickness of the foil is 20 to 100 μm.

29. A glass ceramic cook top, comprising the foil according to claim 25 as a heat conductor foil.

30. A heatable metallic exhaust gas catalyst on a carrier foil, comprising the foil of claim 24 as the carrier foil.

31. A fuel cell, comprising the foil according to claim 24.

32. The alloy according to claim 1, further comprising 0.0001 to 0.05% Mg by weight.

33. The alloy according to claim 1, further comprising 0.0001 to 0.03% Ca by weight.

34. The alloy according to claim 1, further comprising 0.0002 to 0.03% P by weight.

35. The alloy according to claim 1, further comprising a maximum of 0.1% Nb by weight.

36. The alloy according to claim 1, further comprising a maximum of 0.1% V by weight.

37. The alloy according to claim 1, further comprising a maximum of 0.1% Ta by weight.

38. The alloy according to claim 1, further comprising a maximum of 0.01% O by weight.

39. The alloy according to claim 1, further comprising a maximum of 0.5% Ni by weight.

40. The alloy according to claim 1, further comprising a maximum of 0.003% B by weight.

* * * * *